US011453111B2

(12) United States Patent
Eardley et al.

(10) Patent No.: US 11,453,111 B2
(45) Date of Patent: Sep. 27, 2022

(54) AUXILIARY HANDLE FOR A POWER TOOL

(71) Applicant: Ingersoll-Rand Industrial U.S., Inc., Davidson, NC (US)

(72) Inventors: Edward C. Eardley, Easton, PA (US); Timothy R. Cooper, Titusville, NJ (US); Ryan S. Amend, Easton, PA (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 0 days.

(21) Appl. No.: 17/150,085

(22) Filed: Jan. 15, 2021

(65) Prior Publication Data

US 2022/0226980 A1 Jul. 21, 2022

(51) Int. Cl.
*B25G 3/00* (2006.01)
*B25F 5/02* (2006.01)

(52) U.S. Cl.
CPC ..... *B25F 5/026* (2013.01)

(58) Field of Classification Search
CPC ... Y10T 16/469; Y10T 16/4713; A01B 1/026; B25F 5/02; B25F 5/025; B25F 5/026; B25B 13/52; B25D 17/04; B25D 17/043; B23B 45/001; B25G 1/002; B25G 1/005; B25G 1/102; B25G 1/10; B25G 3/00; B25G 3/02; B25G 3/18; B25G 3/20; B25G 3/24; B25G 3/26; B25G 3/28; B25G 3/30
See application file for complete search history.

(56) References Cited

U.S. PATENT DOCUMENTS 3,253,850 A * 5/1966 Trusty ..... B65G 7/12 294/31.1
3,585,704 A * 6/1971 Schroeder ..... B25B 7/02 7/125
5,351,585 A * 10/1994 Leseberg ..... B25B 7/02 81/426
5,460,461 A * 10/1995 McGrath ..... B25B 7/123 269/45
6,079,639 A * 6/2000 Barbato ..... B25F 5/021 239/525
8,235,245 B2 * 8/2012 Lorthioir ..... A47J 45/10 220/759

(Continued)

OTHER PUBLICATIONS

Extended European Search Report for Application No. 22150114.1, dated May 27, 2022.

*Primary Examiner* — Chuck Y Mah
(74) *Attorney, Agent, or Firm* — Kevin E. West; Advent, LLP

(57) ABSTRACT

A power tool comprises an adjustable auxiliary handle assembly that facilities safe use of the tool by the operator when handling heavy duty handheld machinery. The adjustable auxiliary handle assembly comprises a strap, a handle base, an over-center linkage assembly, a locking lever, a locking lever and an adjustable knob. The strap is easily released and able to rotate and be locked in a different position convenient and comfortable to the operator. The auxiliary handle assembly is adjustable and can be operated with one hand (e.g., one-handed operation). The over-center linkage assembly holds the auxiliary handle position in place while allowing the power tool to be used in high-torque/high load applications.

18 Claims, 14 Drawing Sheets

(56) References Cited

U.S. PATENT DOCUMENTS

| | | | | |
|---|---|---|---|---|
| 8,328,170 | B2 * | 12/2012 | Wasinger | B25B 7/123 269/216 |
| 8,407,860 | B2 * | 4/2013 | Brennenstuhl | B25F 5/026 16/422 |
| 9,205,540 | B2 * | 12/2015 | Lin | B25B 27/0042 |
| 9,463,566 | B2 * | 10/2016 | Yoshikane | B25G 1/01 |
| 9,550,278 | B2 * | 1/2017 | White | B60C 25/02 |
| 10,112,287 | B2 * | 10/2018 | Gallagher | B25B 7/02 |
| 2006/0117579 | A1 | 6/2006 | Zeiler et al. | |
| 2007/0209162 | A1 * | 9/2007 | McRoberts | B25F 5/026 16/426 |
| 2017/0280940 | A1 * | 10/2017 | Quinn | A47J 45/07 |
| 2018/0050447 | A1 * | 2/2018 | Geiger | B25F 5/006 |

* cited by examiner

AUXILIARY HANDLE FOR A POWER TOOL

BACKGROUND

Portable (hand-held) power tools include a variety of tools actuated by a power source such as an electric or pneumatic motor that are configured to be held by an operator during use. Depending on the application in which the tools are used, portable power tools vary greatly in size, torque, and speed of operation. Because they are hand-held, portable power tools used in high load/torque applications are often equipped with stability furnishing features typically not found in power tools used in lower load/torque applications.

DRAWINGS

The Detailed Description is described with reference to the accompanying figures. The use of the same reference numbers in different instances in the description and the figures may indicate similar or identical items.

Figure 13:
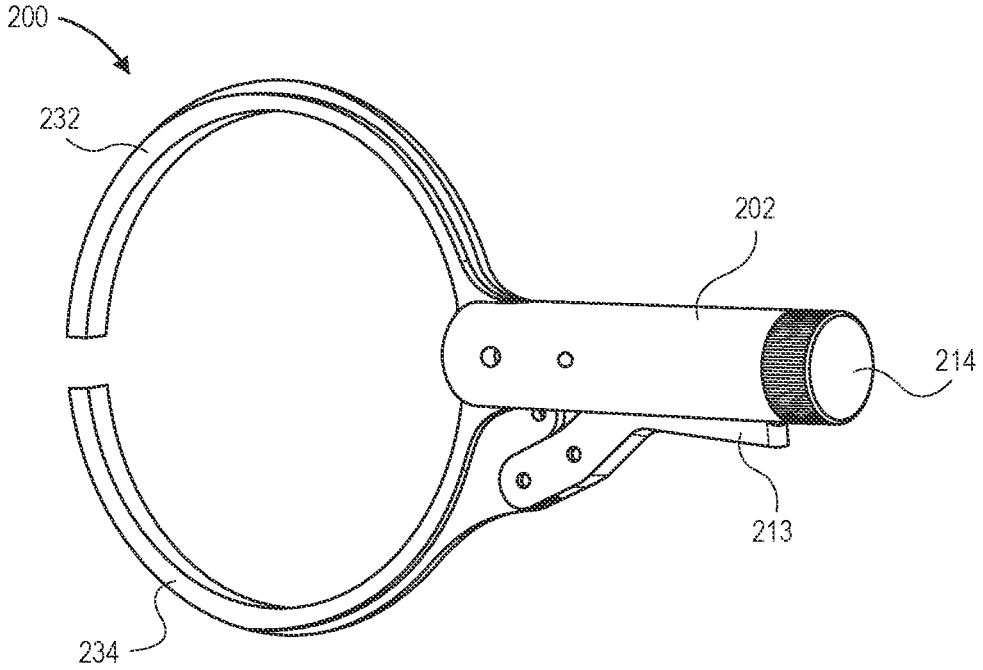

FIG. 13 an isometric view of an auxiliary handle assembly in accordance with example embodiments of the present disclosure.

Figure 14:
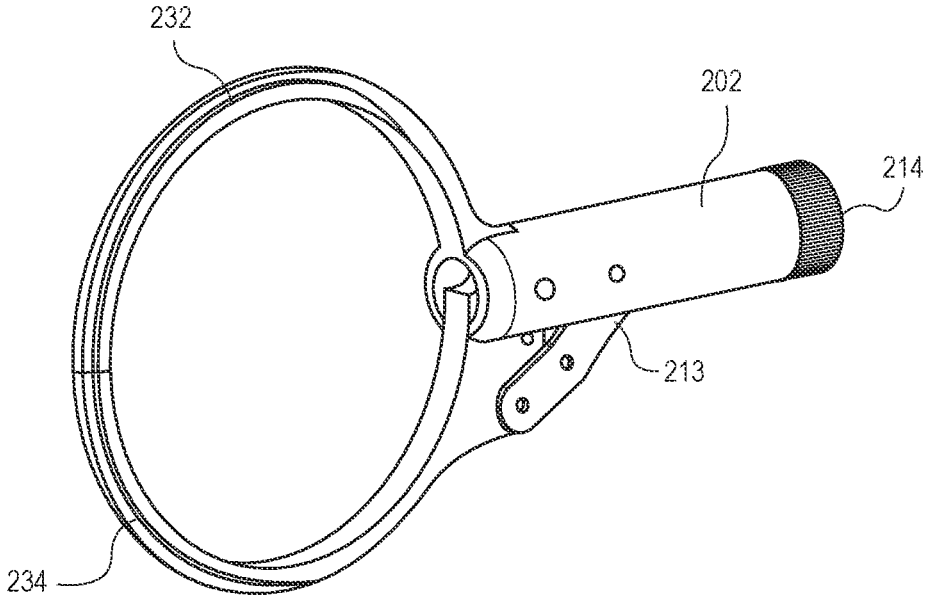

FIG. 14 an isometric view of an auxiliary handle assembly in accordance with example embodiments of the present disclosure.

Figure 15:
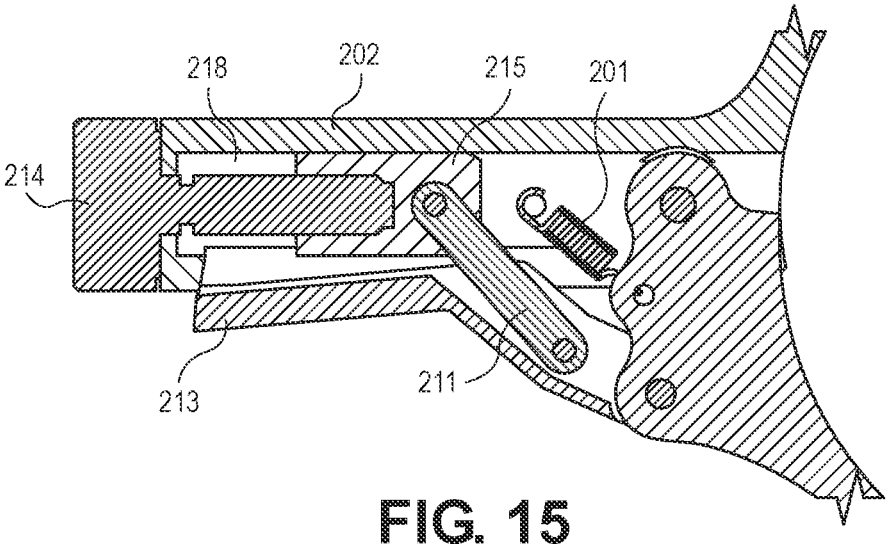

FIG. 15 is a cross-sectional view of a handle base of the auxiliary handle assembly shown in FIG. 13 in accordance with example embodiments of the present disclosure.

Figure 16:
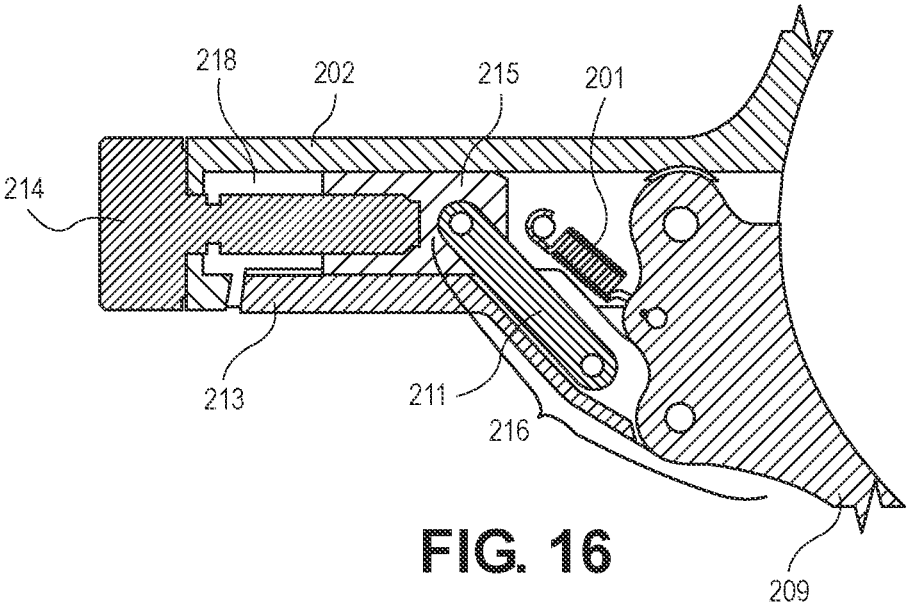

FIG. 16 is a cross-sectional view of a handle base of the auxiliary handle assembly shown in FIG. 13 in accordance with example embodiments of the present disclosure.

Figure 17:
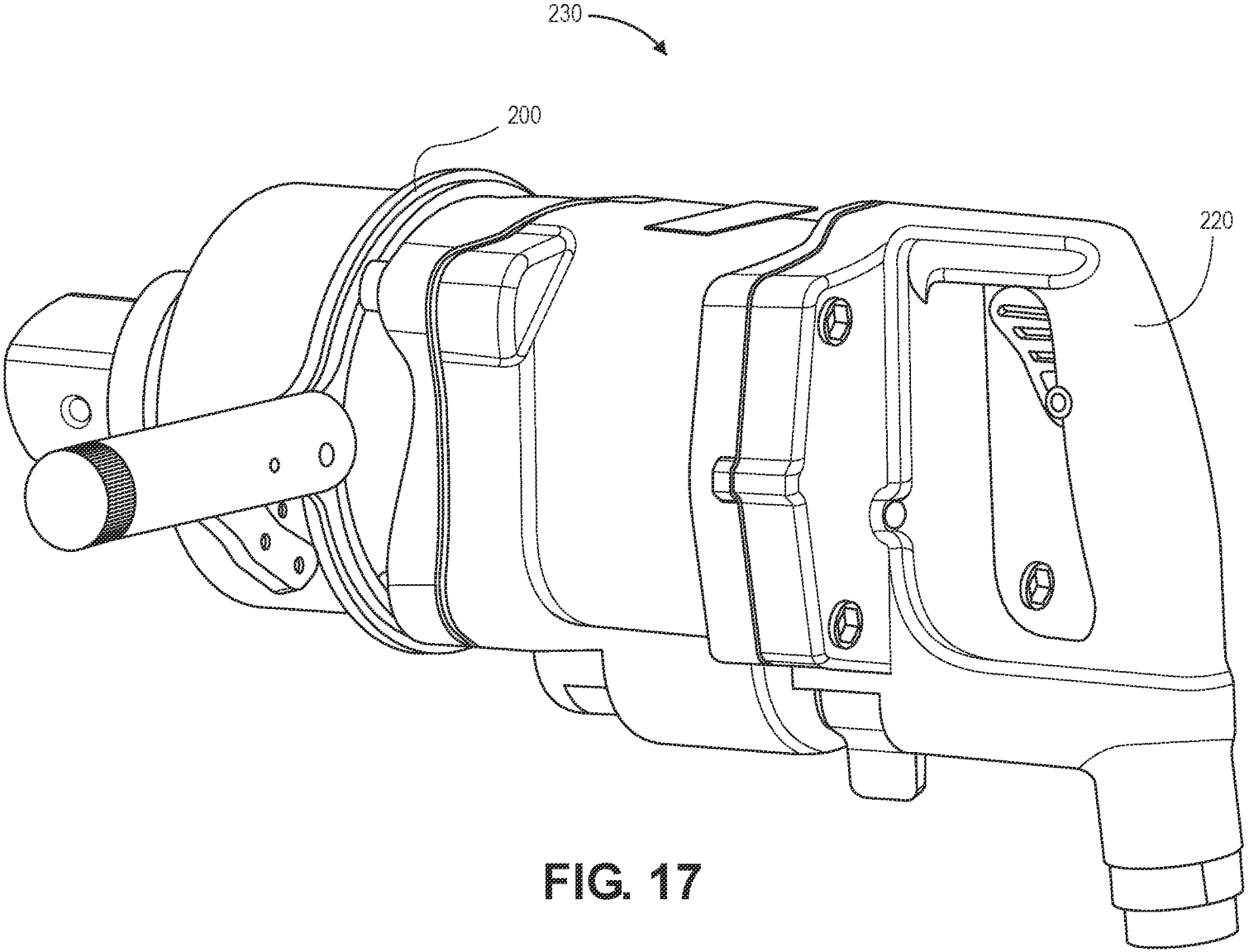

FIG. 17 is an isometric view of a power tool assembly with the auxiliary handle assembly shown in FIG. 13 in accordance with example embodiments of the present disclosure.

Figure 18:
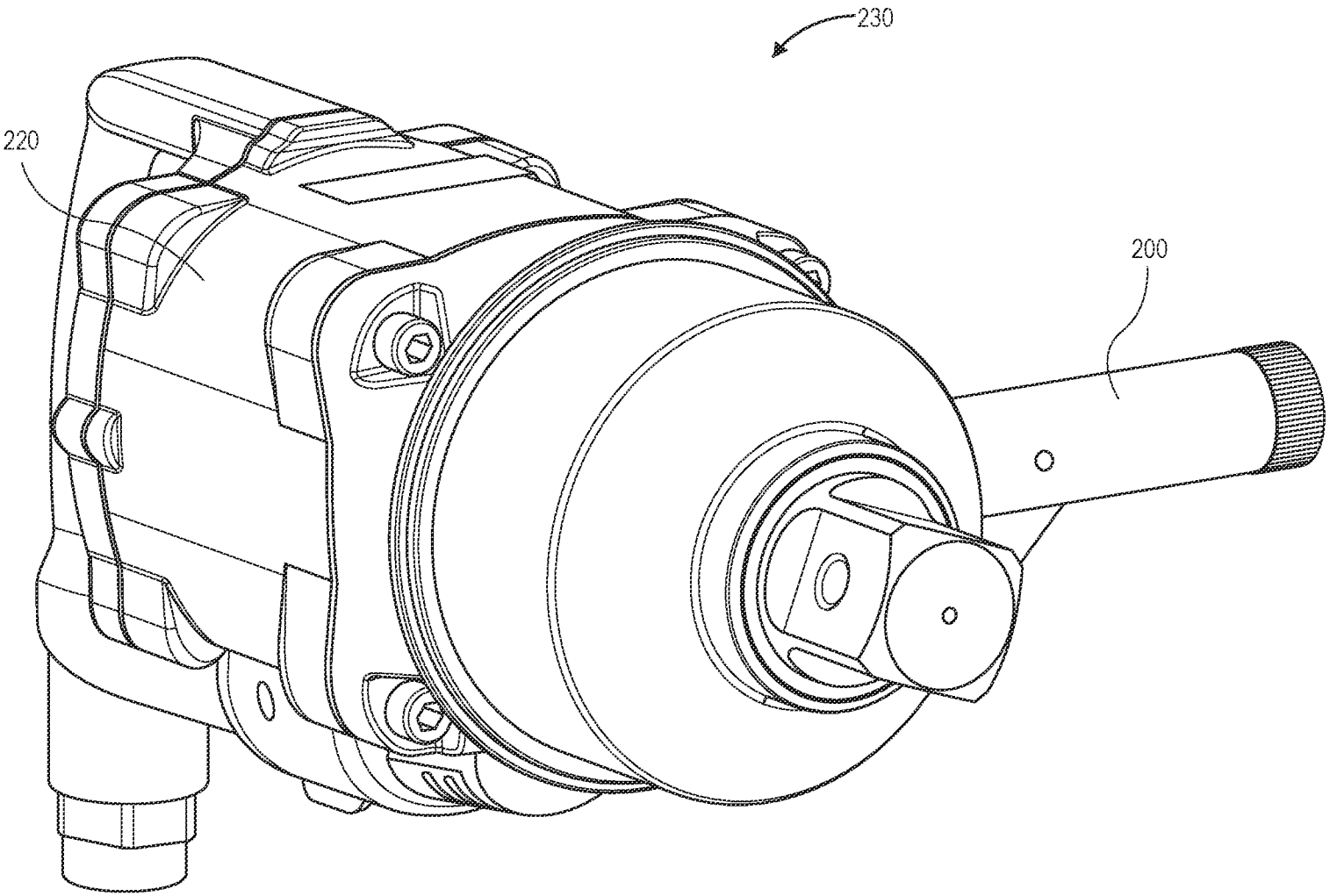

FIG. 18 is an isometric view of a power tool assembly with the auxiliary handle assembly shown in FIG. 13 in accordance with example embodiments of the present disclosure.

DETAILED DESCRIPTION

Overview

Portable (hand-held) power tools vary greatly in size, torque, and speed. Portable power tools designed for heavy duty applications typically have auxiliary (or secondary) handles that allow the user to better position, balance, and control the generally larger and heavier tools during use. For example, holding a high-torque drill having an auxiliary handle in addition to a pistol grip gives an operator increased stability when reactive forces act on the tool.

In some instances, an operator may experience a need to reorient the auxiliary handle of a heavy-duty power tool to better control the power tool. However, repositioning of the auxiliary handle typically requires the use of a supplementary hand tool such as a key, Allen wrench, crescent wrench, socket wrench, or the like to remove and reorient (e.g., to adjust, loosen, and tighten) the auxiliary handle to the power tool.

Accordingly, the present disclosure is directed to an auxiliary handle assembly for a power tool that facilitates use of the power tool by the operator by allowing the operator to quickly reorient the auxiliary handle with respect to the power tool (e.g., rotate the auxiliary handle through an arc of three-hundred-and-sixty degrees (360°) about the housing of the power tool). In embodiments, the auxiliary handle assembly includes a strap that encircles a barrel portion of the housing of the power tool. The auxiliary handle assembly further includes a handle base connected to the strap and an over-center linkage assembly within a chamber of the handle base. The auxiliary handle assembly further includes a lever connected to the handle base that locks the strap around the housing of the power tool, and a release connected to the handle base to release the lever when the lever is in a locked state.

The auxiliary handle assembly is thus easily rotated about the barrel of the housing of the power tool and can be operated by the operator with one hand (e.g., one-handed operation). The over-center linkage assembly secures the auxiliary handle position to the power tool, allowing the power tool to be used in high-torque/high load applications without undesired movement of the handle.

Detailed Description of Example Embodiments

FIGS. 1 through 18 illustrate an auxiliary handle assembly 100 in accordance with example embodiments of the present disclosure. A power tool assembly 130 comprises a portable hand-held power tool 120 to which the auxiliary handle assembly 100 is mounted. The auxiliary handle assembly 100 includes a strap 112 to be mounted to the power tool 120. The strap 112 is connected to a handle base 102 having an over-center linkage assembly 116 coupled to the strap 112 and a lever 113 pivotably connected to the handle base 102. The over-center linkage 116 assembly magnifies the force provided to the lever by a user, locking the strap 112 around the power tool 120 and providing a steady hold to support the size and/or weight of the power tool assembly 130.

In the embodiment illustrated, the power tool 120 comprises an impact wrench. However, those of skill in the art will understand that the power tool assembly 130 is not necessarily limited to the power tool 120 illustrated, and that a variety of different elements that may require additional support when in use may be used in conjunction with auxiliary handle assembly 100. For example, other power tools 120 suitable for use by the power tool assembly 130 can include, but are not limited to, nut runner tools, impact wrenches, grinders, drills, combination hammers, and so forth. It is also contemplated that the power tool 120 may be driven by an electric motor powered by a power source such as a removable battery, an internal battery, or an external power, or may comprise a pneumatic tool having a pneumatic (compressed air) motor powered by a source of compressed air.

Figure 12:
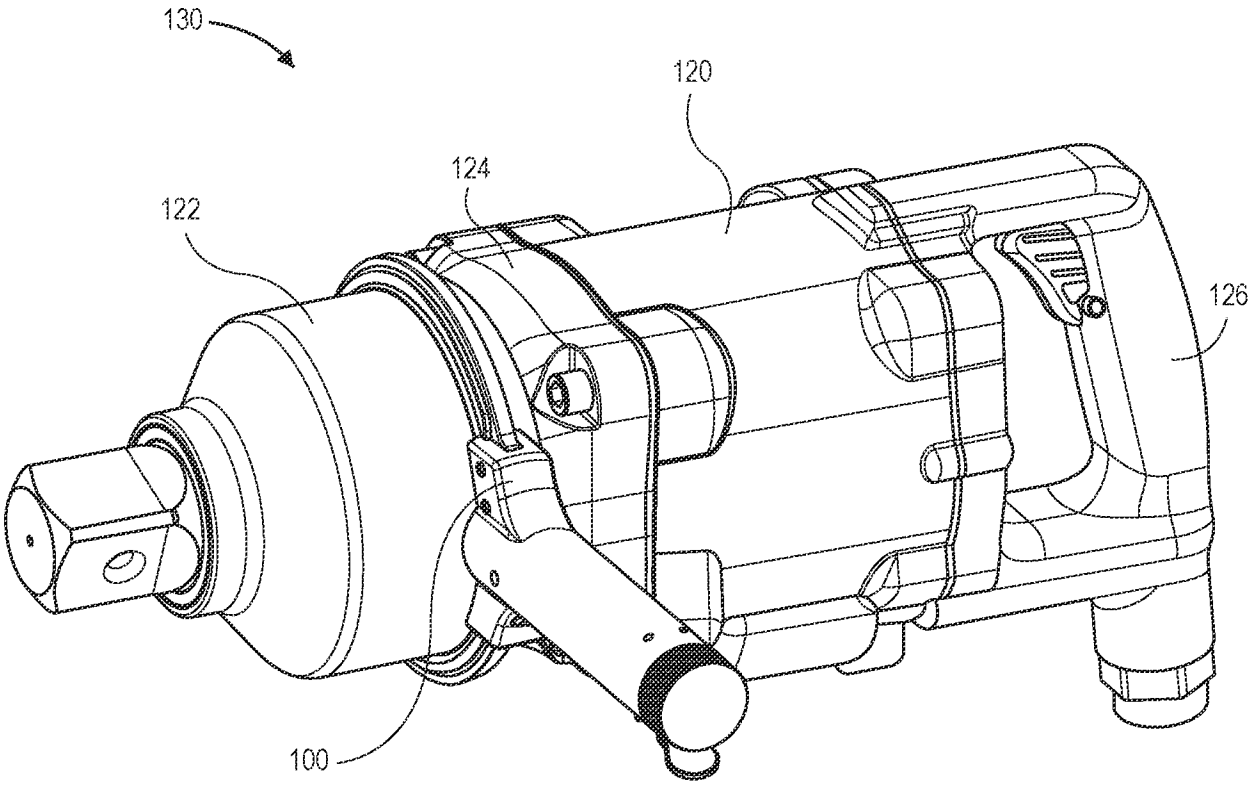
FIG. 12 is an isometric view of a power tool assembly with the auxiliary handle assembly shown in FIG. 1 in accordance with example embodiments of the present disclosure.

In the embodiment illustrated, the power tool assembly 130 includes a power tool 120 including a housing 124 having a barrel portion 122 as shown in FIG. 12. The housing 124 also includes a primary handle 126 configured to be grasped by an operator when using the power tool assembly 130. For example, the primary handle 126 may be used by the operator to pick up the power tool assembly 130, move it and guide it onto a workpiece. The primary handle 126 allows the operator to impart force to hold the power tool assembly 130 against the workpiece.

In accordance with the present disclosure, the power tool assembly 130 includes an auxiliary handle assembly 100. The auxiliary handle assembly 100 allows the operator to resist the torque output of the power tool assembly 130 in high torque operations. As shown more specifically in FIGS. 12, 17 and 18, the auxiliary handle assembly 130 is coupled to the barrel 122. Other configurations of the power tool assembly 130 may include an auxiliary handle assembly 100 that is coupled to the power tool 120 instead of the barrel 122.

Figure 1:
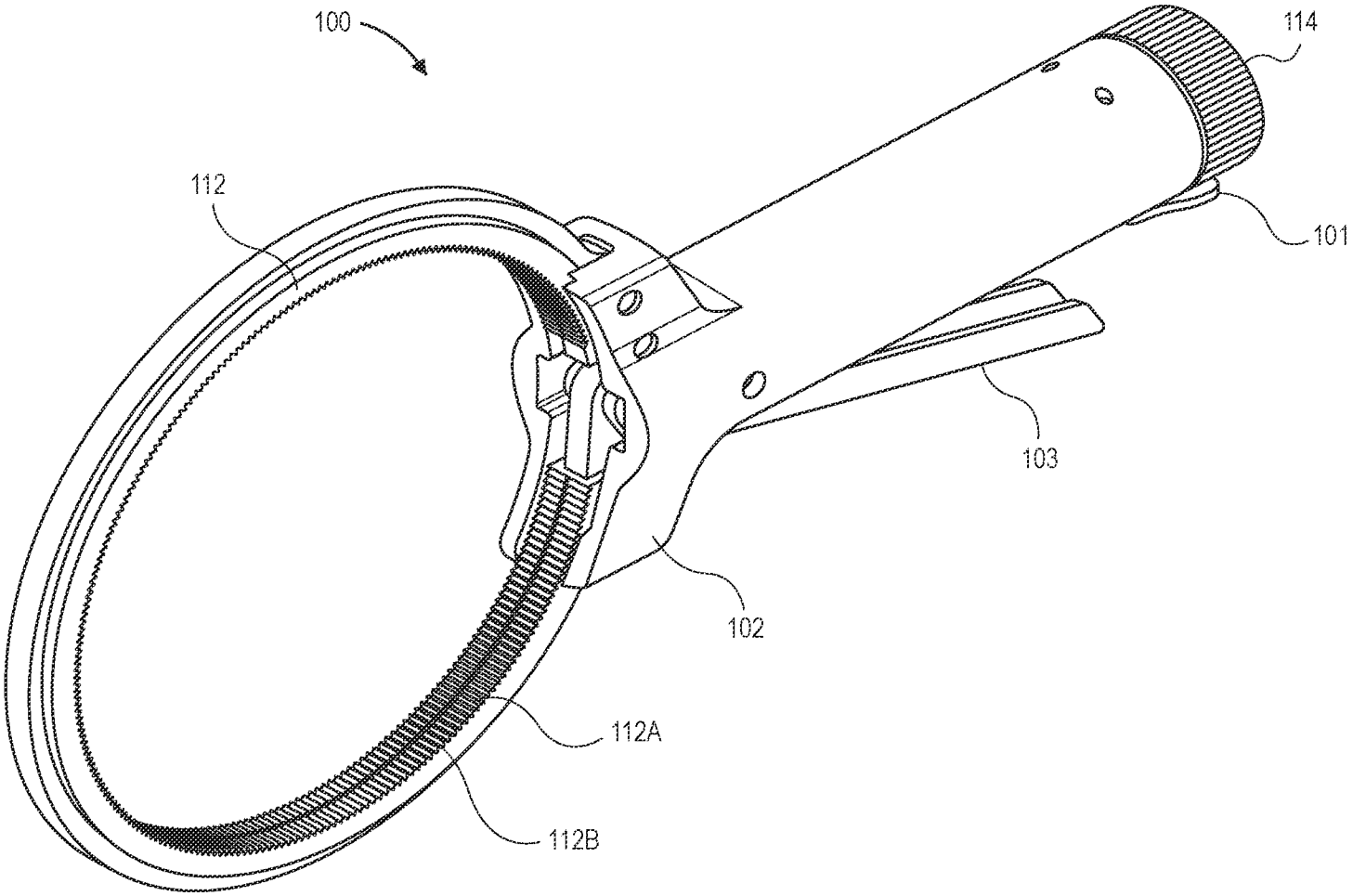
FIG. 1 is an isometric view of an auxiliary handle assembly in accordance with example embodiments of the present disclosure.
Figure 2:
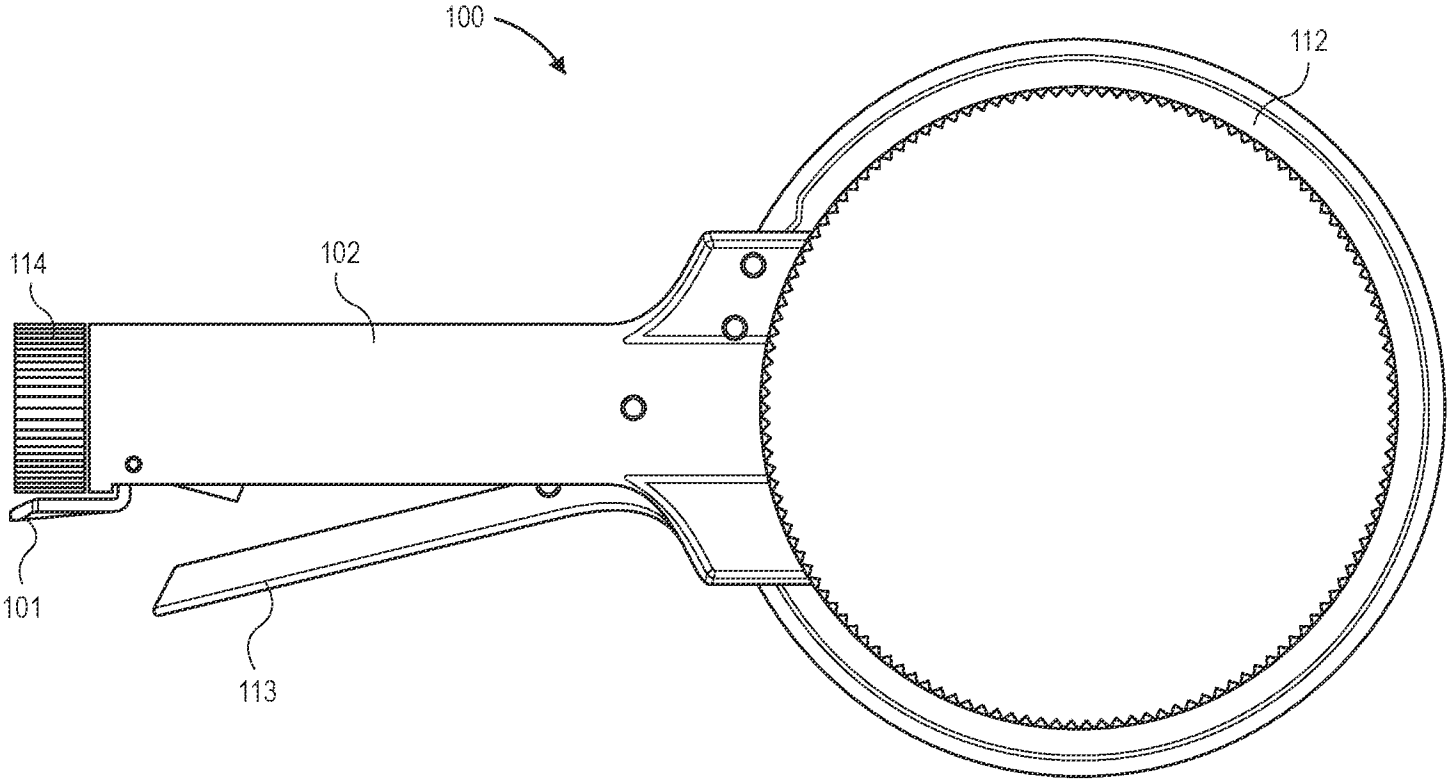
FIG. 2 is a side view an auxiliary handle assembly shown in FIG. 1 in accordance with example embodiments of the present disclosure.

As shown in FIGS. 1 and 2, the auxiliary handle assembly 100 includes a handle base 102, a strap 112, a locking lever 113, a release lever 101 and an adjusting knob 114. The handle base 102 extends radially from the strap 112 at an angle of approximately ninety degrees (90°). However, in embodiments, the auxiliary handle assembly 100 may connect the handle base 102 with the strap 112 at an angle other than ninety degrees (90°).

The handle base 102 may include a features such as grooves or splines (not shown) formed in its surface to improve the grip of an operator. These features, may, for example, be formed using a knurling process. Examples of knurling that may be used in the handle base 102 to increase the improve the grip between the operator's hand and the auxiliary handle assembly 100 include, but are not limited to, linear or straight knurling, diagonal knurling, and diamond knurling. Additionally or alternatively, the surface of the auxiliary handle assembly 100 may be rubberized (e.g., include surface tubing or another type of elastomer sleeve to improve the grip of the operator's hand and the handle base 102.

Figure 3:
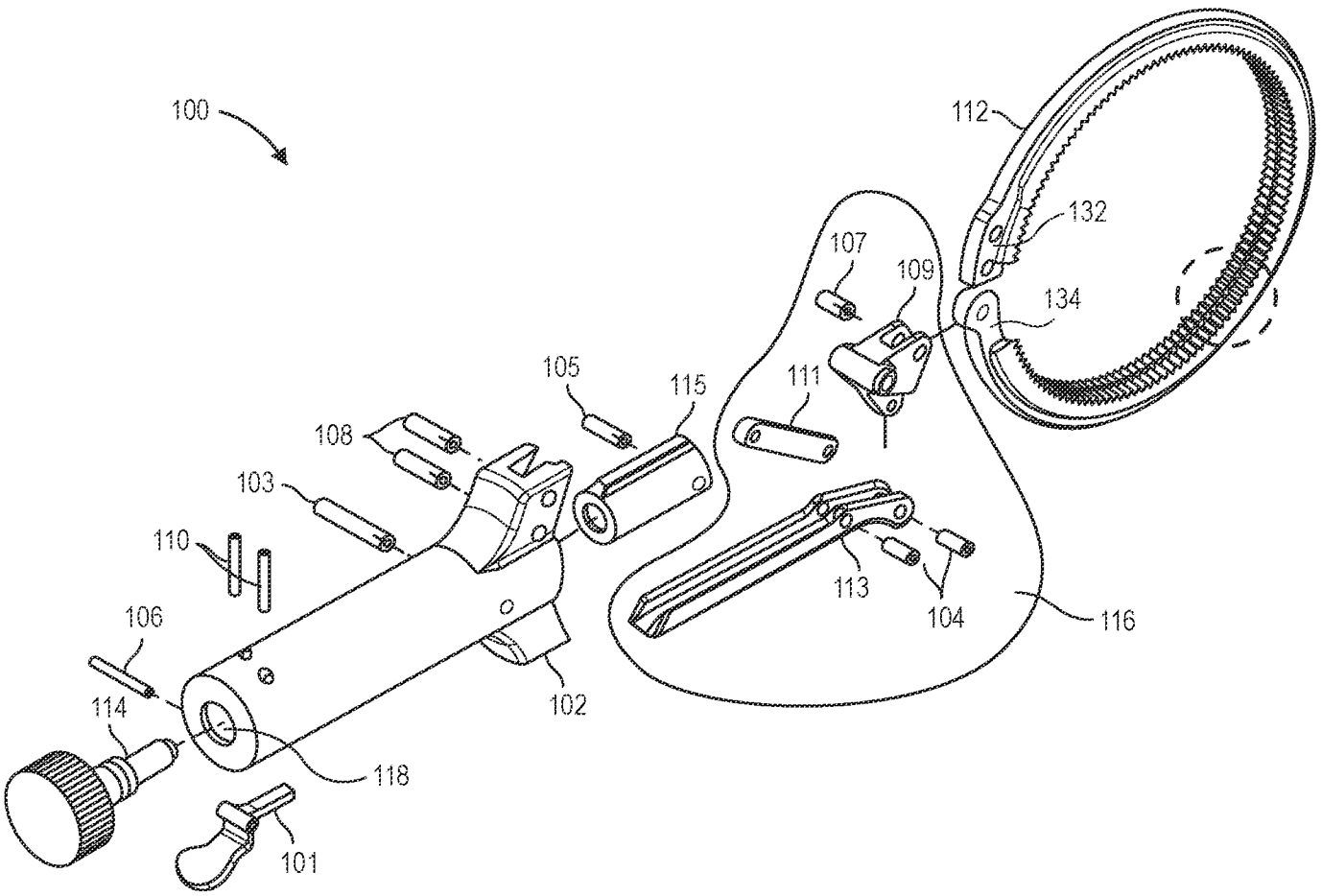
FIG. 3 is an exploded view of the auxiliary handle shown in FIG. 1 in accordance with example embodiments of the present disclosure.

As shown in FIG. 3, the component of the auxiliary handle assembly 100 are described. In the embodiment shown, the auxiliary handle assembly 100 includes a handle base 102 having a chamber 118. The chamber 118 houses a yoke 115, an over-center linkage assembly 116 having a linking arm 111 and a spindle 109, a release lever 101, and an adjusting knob 114 coupled to the end of the handle base 102 opposite to the a strap 112. The strap 112 may be a generally a continuous circular member that comprises a first end 132 and a second end 134 coupled to the handle base 102. However, in other embodiments, the strap may not be a continuous member and have an opening around the periphery of the strap, having the strap 112 be used as clamping arms, for example, as shown in FIGS. 13 through 18.

Figure 4:
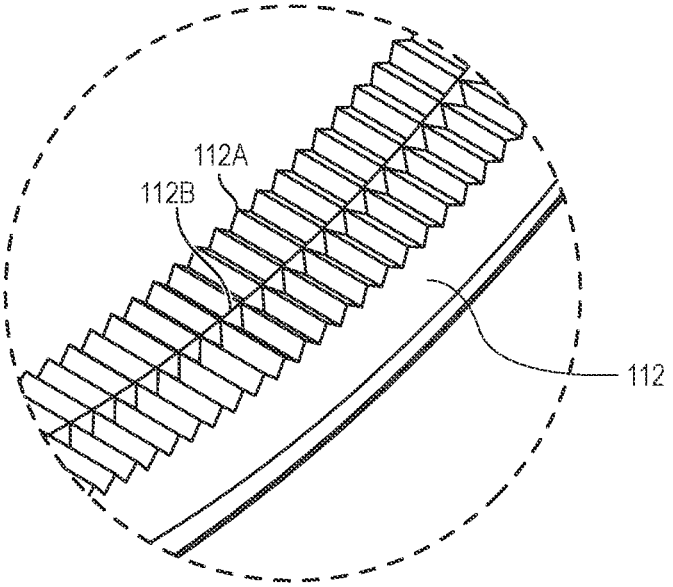
FIG. 4 is a detailed view of a section of a strap as shown in FIG. 3 illustrating the inner circumference of a circular strap in accordance with example embodiments of the present disclosure.

As shown in FIG. 4, a detailed view of the inside diameter of the strap 112 is shown. The strap 112 includes a straight-cut transverse row of teeth 112A around the inside diameter of the strap that digs into the contours of the barrel portion 122 of the power tool 120 and prevents the strap from slipping rotationally around the barrel portion 122 when the auxiliary handle is in a locked position. The strap 112 also includes at least one lateral tooth 112B parallel to the transverse row of teeth 112A through the center of the strap 112. When the auxiliary handle assembly 100 is in the locked position, the at least one lateral tooth 112B digs into the contours of the barrel portion 122 of the power tool 120 and prevents the strap 112 from slipping axially off the barrel portion 122 when the power tool is in use.

Figure 5:
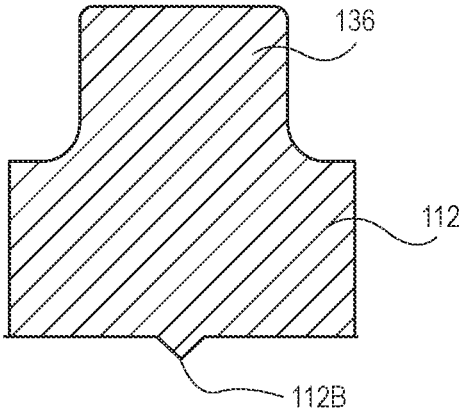
FIG. 5 is a cross-sectional view of the strap as shown in FIG. 4 in accordance with example embodiments of the present disclosure.
Figure 6:
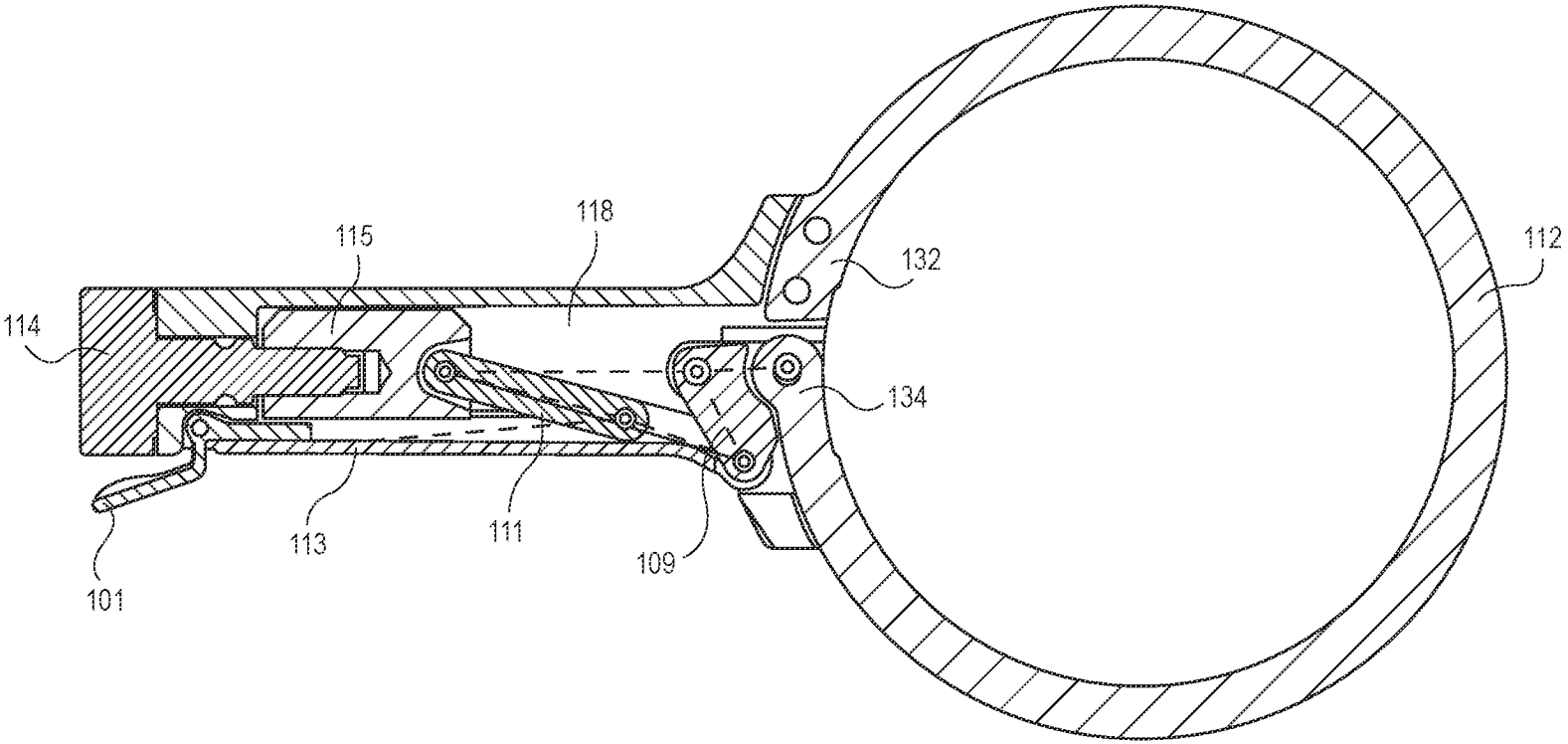
FIG. 6 is a cross-sectional view of the auxiliary handle assembly shown in FIG. 1 in accordance with example embodiments of the present disclosure.
Figure 7:
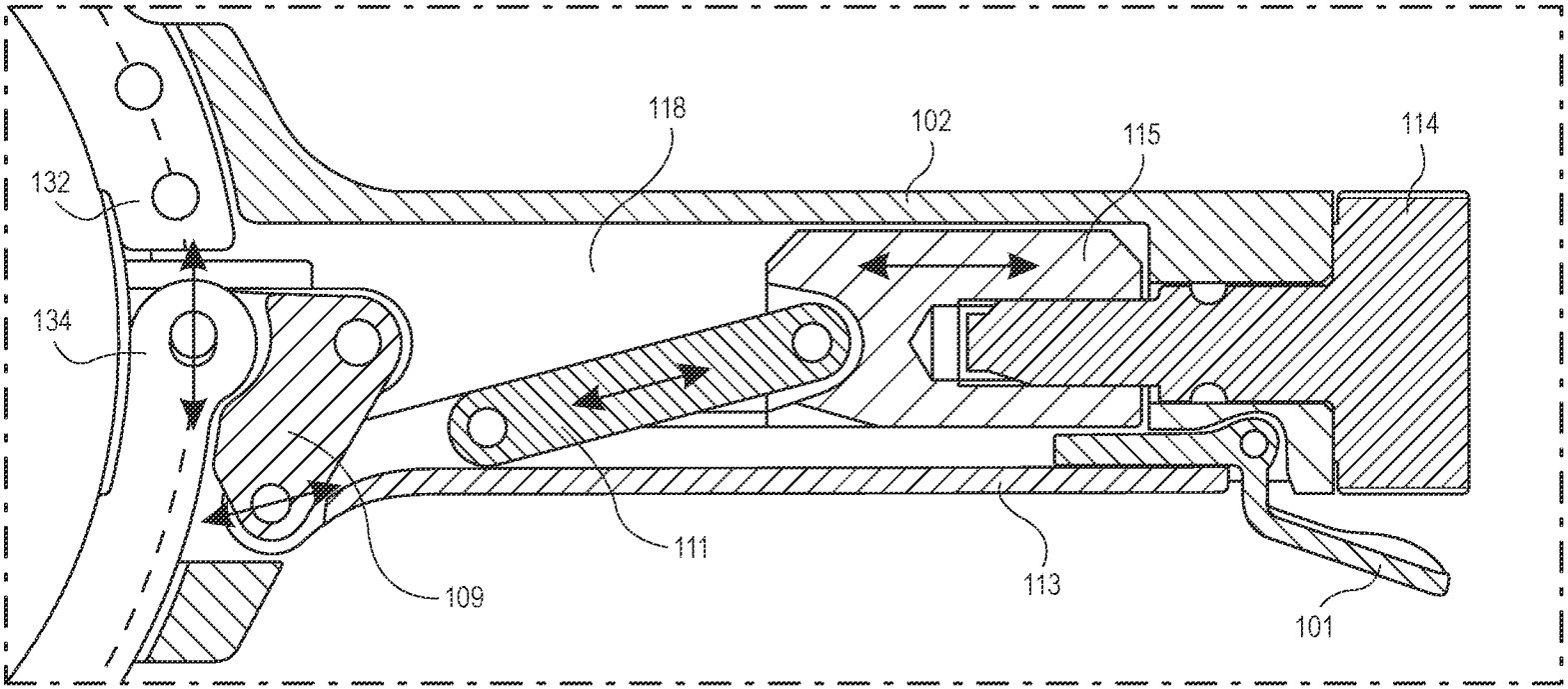
FIG. 7 is a cross-sectional view of a handle base of the auxiliary handle assembly shown in FIG. 6 in accordance with example embodiments of the present disclosure.

FIG. 5 illustrates a cross-sectional view of the strap 112 having the at least one lateral tooth 112B and a ridge-line support 136. The ridge-line support 136 increases the rigidity and strength and reduces the elasticity of strap 112. The ridge line support prevents rocking between the strap 112 and the power tool 120 when the handle base 102 is pushed towards the front of the power tool 120 when the power tool assembly 130 is in use. This ridge-line support is not limiting and some embodiments of the present disclosure may be designed without the ridge line support.

FIGS. 6 through 9 show a cross-sectional view of the handle base 102 of the auxiliary handle 100. The locking lever 113 is rotationally connected to the spindle 109 and linking arm 111 by cylindrical pins 104. The spindle 109 is attached to the second end of the strap 134 by cylindrical pin 107, causing the second end of the strap 134 to rotate about this connection. The first end of the strap 132 is fixedly connected to the handle base 102. When a user actuates and pushes the locking lever 113 against the handle base 102, the locking lever 113 rotates the spindle 109 around its anchor point and closes the opening of the strap between the first end 132 and second end 134. By closing the opening of the strap, the internal diameter of the strap is reduced. When the strap 112 is in its resting state and wrapped around a barrel portion 122 of power tool 120 or another object that has a similar or equivalent diameter such as the strap 112, the strap can slide along the barrel portion 122 to a desired position along its longitudinal axis. As a user actuates the locking lever 113, causing the strap 112 to lock around the barrel portion 122, the internal diameter of the strap is closed and reaches the boundary of the outside diameter of the barrel portion 122. As the strap's diameter cannot be reduced further, any additional force by the user to the locking lever is translated into clamping force.

The adjusting knob 114 allows fine adjustments to the angle of the locking lever 113 when the strap 112 is in a resting state. The adjusting knob 114 may be threaded into the yoke 115 and used to move the yoke 115 along the longitudinal axis of chamber 118 within handle base 102. The linking arm 111 is attached to the yoke 115 at a first end by cylindrical pin 105 and to the locking lever 113 by cylindrical pin 104. The cylindrical pins allow the linkage to move along the plane equivalent to the plane of movement of the locking lever 113.

When the adjusting knob 114 is operated, the threaded interface between the adjusting knob 114 and the yoke 115 forces the yoke 115 to axially move back and forth along the handle base chamber 118. The movement of the yoke 115 respectively moves the linking arm 111 back and forth, rotating the locking lever 113 about its pinned connection to the spindle 109 and changing the angle of the locking lever 113 with respect to the handle base 102. In the embodiment shown in FIG. 7, if the yoke 115 is pushed towards the linking arm 111, the angle between the locking lever 113 and the handle base 102 is increased. Alternatively, if the yoke is pulled away from the linking arm 111, the angle between the locking lever 113 and the handle base 102 is decreased.

The larger the angle between the handle base 102 and the locking lever 113 when the auxiliary handle assembly 100 is in a resting state, the greater the resulting rotation on the spindle 109 is achieved when the user activates and pushes the locking lever 113. This greater rotation on the spindle 109 results in a greater clamping force by the strap 112 since there is a greater reduction in the opening between the first end of the strap 132 and the second end of the strap 134. Alternatively, a smaller angle between handle base 102 and the locking lever 113 when the auxiliary handle assembly 100 is in a resting state, will result in a lower clamp force by the strap 112 around a barrel portion 122 when the locking lever 113 is actuated by the user.

Figure 10:
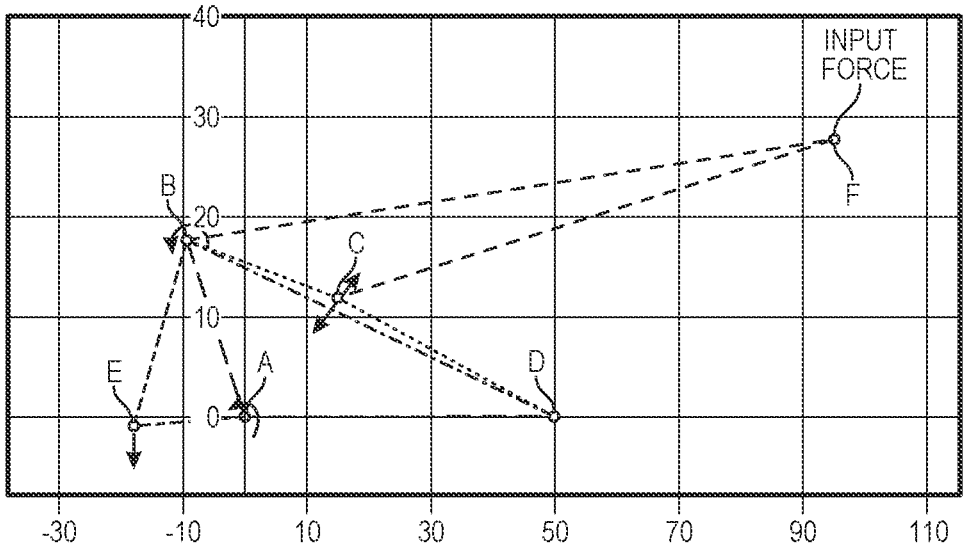
FIG. 10 is a diagram of the four-bar mechanism used by example embodiments of the present disclosure.
Figure 11:
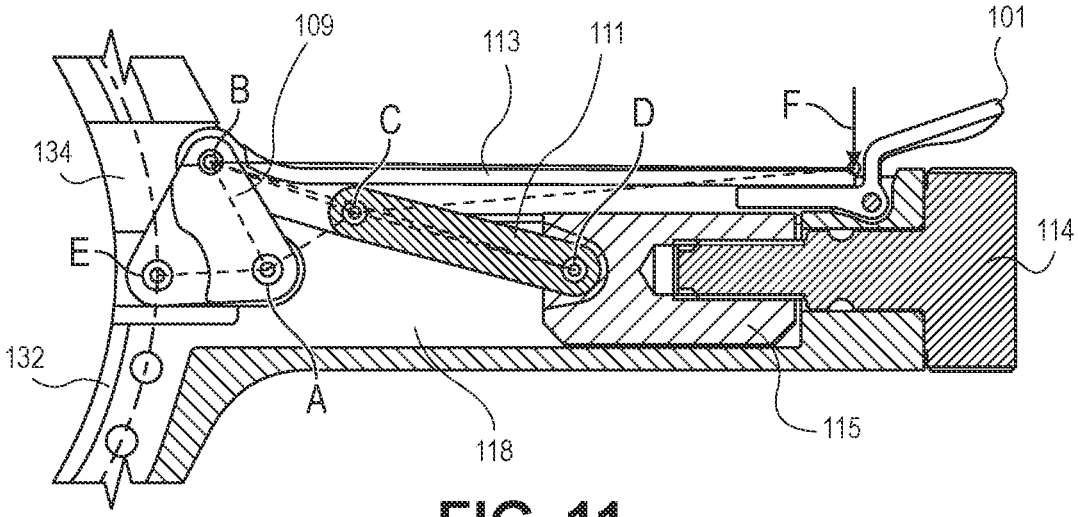
FIG. 11 is a side view of the four-bar mechanism from FIG. 10 transposed unto the cross-sectional view of the handle base shown in FIG. 7 in accordance with example embodiments of the present disclosure.

As shown in FIGS. 10 and 11, the auxiliary handle assembly 100 is locked using the over-center linkage assembly 116. A four-bar mechanism, comprised of bar A-B, bar B-C, bar C-D and bar D-A, magnifies the force input to the locking lever 113 at point F. This magnification of the input force is achieved when a large angular movement of the locking lever 113 results in a small movement of the second end of the strap 134. For example, with a ratio of 100:1, for every 1.0 degree of handle movement, the second end of the strap 134 moves and closes tightens the strap 112 by 0.01 degrees. An input force of 100 lbs. on the locking lever 113 at point F results in 10,000 lbs. of output force at the strap 112 at point E. This ratio varies throughout the limits of angular movement of the mechanism and is not intended to limit the present disclosure.

Figure 8:
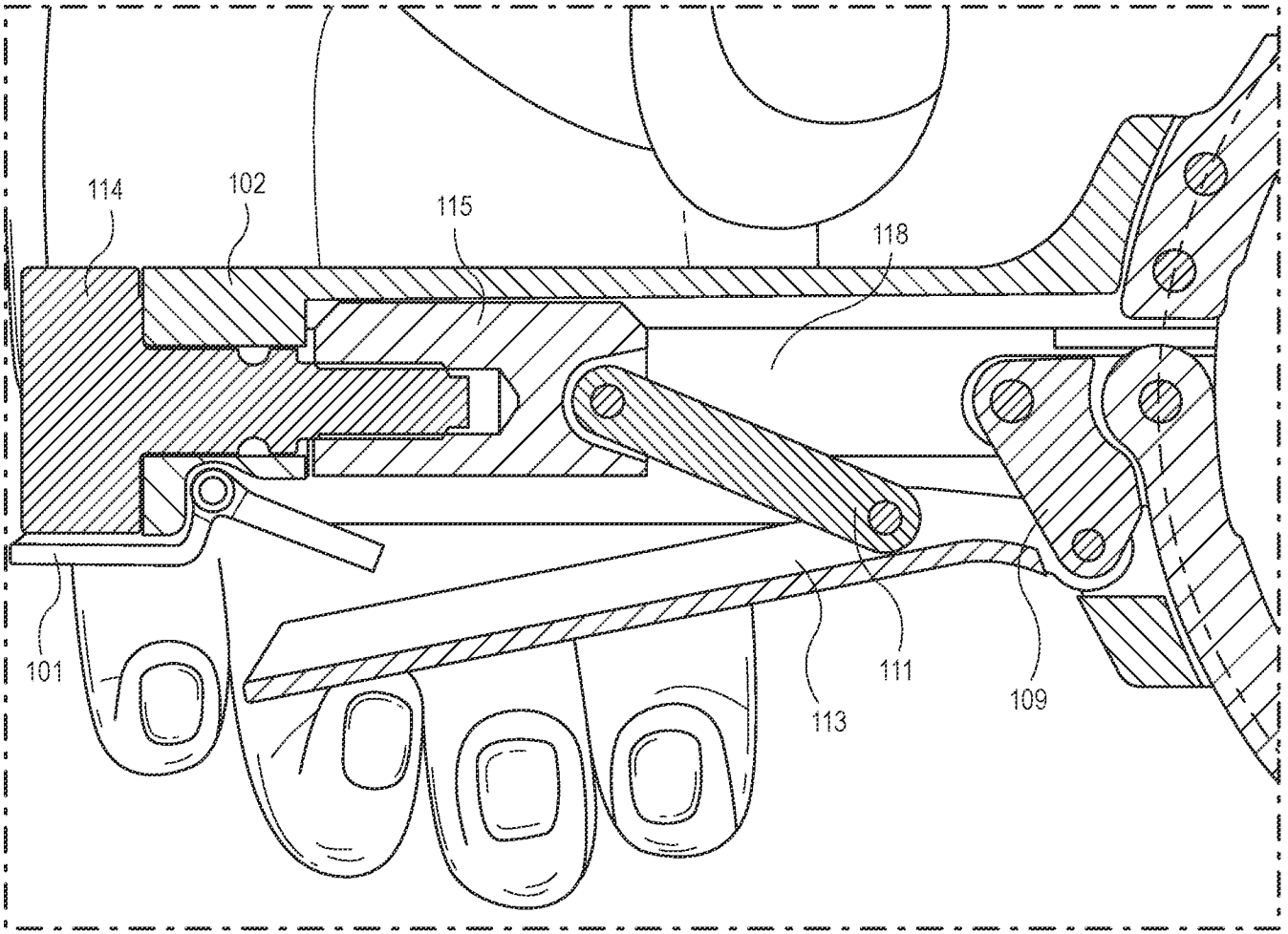
FIG. 8 is a cross-sectional view of a handle base of the auxiliary handle assembly shown in FIG. 6 wherein a locking lever is being actuated in accordance with example embodiments of the present disclosure.
Figure 9:
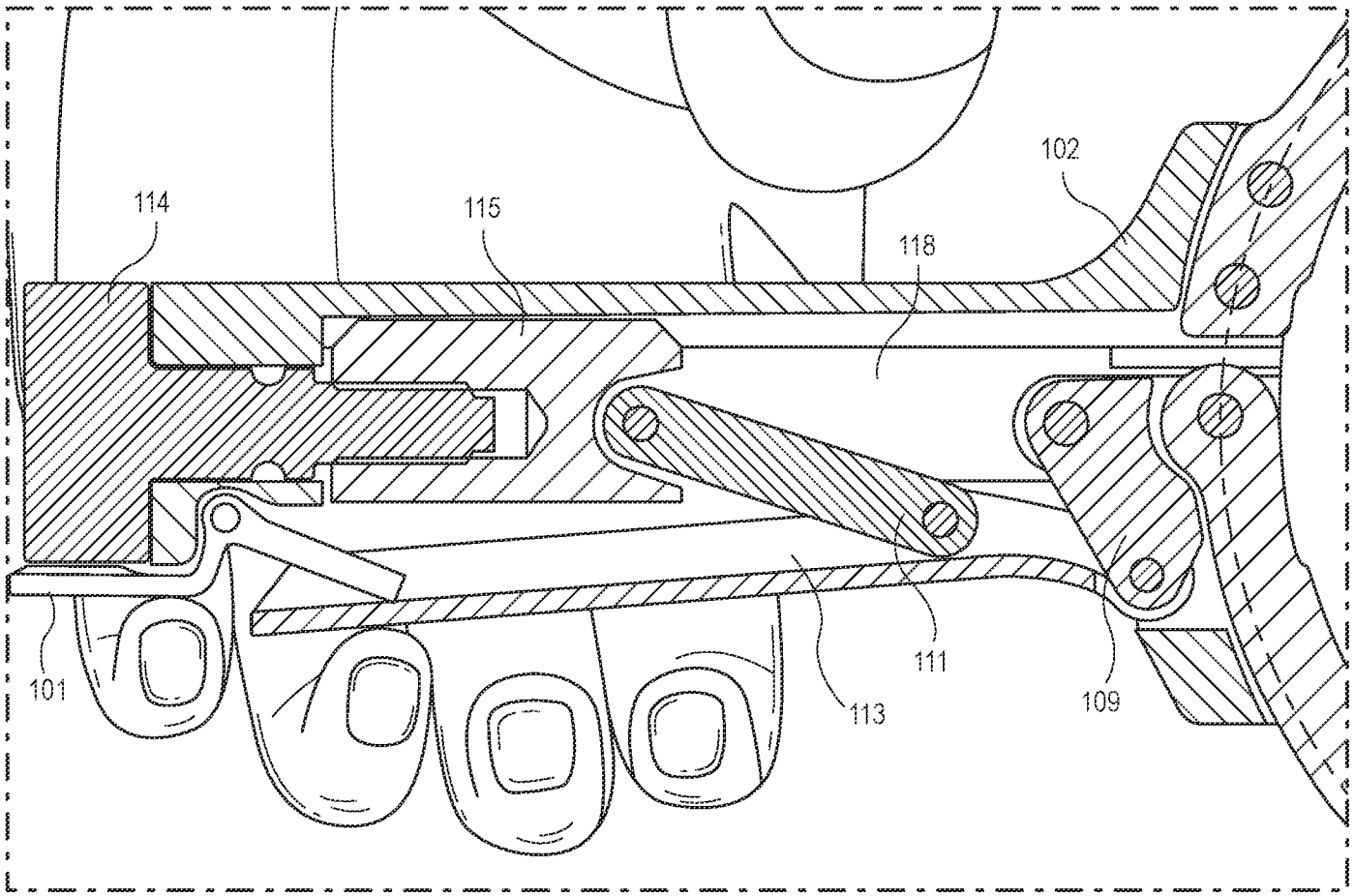
FIG. 9 is a cross-sectional view of a handle base of the auxiliary handle assembly shown in FIG. 6 wherein a release is being actuated in accordance with example embodiments of the present disclosure.

The over-center linkage assembly 116 is represented by the three points of relational motion B, C, and D in FIG. 10. When the auxiliary handle assembly 100 is in a resting state as shown in FIG. 8, points B, C, and D create a "V" shape. As the locking lever 113 is closed as shown in FIG. 9, the "V" shape formed by points B, C, and D is flattened until the three points are colinear. The position of the locking lever 113 where points B, C, and D are in alignment is the point of maximum mechanical advantage, resulting in the maximum clamp force exerted by the strap 112 unto the barrel portion 122, and will be referred to as the dead-center state or "clamping stage". Any additional closing of the locking lever 113, moving the over-center linkage assembly 116 past the dead-center state, moves the three points B, C, and D, into an "over-center" state, creating an inverted "V" shape, also referred to as a "locking stage." Any attempt to open or release the strap 112 will result in biasing the three points B, C, and D further into a greater inverted "V" shape until they cannot move further, decreasing the angle between bars B-C and C-D, and the over-center linkage assembly 116 further into the locked state. The over-center linkage assembly 116 will remain in the locked state when the angle bars B-C and C-D cannot move further into the inverted "V" shape.

The locking state achieved by the over-center linkage assembly can be overcome by acting on one of the three points that make up the over-center linkage, B, C, and D by moving the points back into a dead-center state and returning to the original "V" shape obtained when the auxiliary handle assembly 100 is in a resting position. This may be achieved by pushing directly on point C, or by applying a force to bar B-F in a direction opposite to the input force applied to locking lever 113 at point F. A release lever 101 is in contact with locking lever 113 when the locking lever 113 is actuated. When actuating release lever 101, point C in the locking lever 113 is pushed past the locking stage and the clamping stage, returning the locking lever to its resting state and releasing the clamping force exerted by strap 112.

As mentioned above regarding the adjusting knob 114 and the yoke 115, the lateral distance between points A and D are adjustable. Changing the distance between A and D changes the position of point B when the mechanism in in the clamping stage due to the constant distance between points A and B and the variable angle between bars A-B and A-D (which is affected by the distance between points A and D). Adjusting the position of point B sets a starting position for the second end of the strap 134 at point E, affecting the output clamping force of strap 112. This allows the auxiliary handle assembly to provide the necessary clamping force on working tools with a wide range of diameters, tolerances, and shapes to operate in low-torque and high-torque applications.

An alternative example embodiment of the auxiliary handle assembly is shown in FIGS. 13 through 18. Referring to FIGS. 13 and 14, an auxiliary handle assembly 200 comprises a first clamping arm 232, a second clamping arm 234, a handle base 202, a locking lever 213, and an adjusting knob 214. First clamping arm 232 and second clamping arm 234 form an opening diametrically opposed to the handle base 202 when the auxiliary handle assembly is in a resting position. When a user actuates locking lever 213, the opening formed by first clamping arm 232 and second clamping arm 234 is closed.

FIGS. 15 and 16 show a cross-sectional view of the example embodiment shown in FIGS. 13 and 14. The auxiliary handle assembly 200 includes the handle base 202 having a chamber 218. Chamber 218 houses a yoke 215, a linkage assembly 216 having a linking arm 211 and a spindle 209, a biasing member 201, and an adjusting knob 214 coupled to the end of the handle base 202 opposite to the first and second clamping arms 232 and 234. The first and second clamping arms 232 and 234 form a generally circular shape. However, in other embodiments, the clamping arms 232 and 234 may form a squared shape, a rectangular shape, an oval shape, an irregular shape, and so forth.

In example embodiments, a release lever is not needed, and the auxiliary handle assembly uses a biasing member 201 to release the linkage assembly 216 from its actuated position. Biasing member 201 may push the spindle 209 in a direction opposite to the input force applied to the locking lever 213. Biasing members may include but are not limited to tension springs, torsion springs, compression springs, leaf springs, and so forth.

The auxiliary handle assembly 100 described in the present disclosure accommodates various barrel sizes and thus may be adapted for use on power tool assemblies having various power tool sizes. The strap 112 may be designed with a specific diameter that can be used on power tools with similar barrel diameters but may be interchanged with a strap with a different length or diameter for product models having a barrel diameter outside of the original adjustability range of the strap 112.

The auxiliary handle assembly 100 used in power tool assembly 130 does not require additional tools to operate (e.g., wrenches, hex-keys, etc.), allowing the user to completely rotate the auxiliary handle assembly 100 by three-hundred-and-sixty degrees (360°) about the barrel portion 122 and lock the auxiliary handle assembly 100 into any angular position around the power tool 120 in a one-handed operation. This keeps the second hand of the user free to hold the primary handle 126 and support the weight of the power tool assembly 130 during use of the power tool 120 and during repositioning of the auxiliary handle assembly 100.

It is to be understood that the terms "operator" and "user" are used interchangeably herein to describe any who uses, operates, and/or transports the power tool assembly 100.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A power tool assembly comprising:

a power tool comprising a housing having a barrel portion; and an auxiliary handle assembly comprising:

a strap configured to encircle the barrel portion, the strap having a first end and a second end;

a handle base coupled to the first end of the strap, the handle base having a chamber disposed therein and a yoke disposed within the chamber; and an over-center linkage assembly disposed within the chamber, the over-center linkage assembly having a first end coupled to the yoke, a second end rotatably coupled to the second end of the strap, and a lever pivotally coupled to the handle base and the second end of the over-center linkage assembly, the lever configured to cause the second end of the over-center linkage assembly to rotate over center in a first direction when the lever is depressed against the handle base to engage the strap against the barrel portion for securing the auxiliary handle assembly to the power tool.

2. The power tool assembly as recited in claim 1, wherein the over-center linkage assembly comprises a four-bar linkage.

3. The power tool assembly as recited in claim 1, wherein the first end of the over-center linkage assembly further comprises a linking arm coupled to the yoke and the lever, and the second end of the over-center linkage assembly comprising a spindle having a first point, a second point and a third point, the spindle pivotably coupled to the handle base at the first point, the lever at the second point, and pivotably coupled to the second end of the strap at the third point, wherein the spindle is rotated around the second point of the spindle when the lever is depressed against the handle, rotating the strap about the third point of the spindle and closing the strap around the barrel portion of the housing of the power tool.

4. The power tool assembly as recited in claim 3, wherein the handle base includes an adjusting assembly, the adjusting assembly configured to adjust a clamping force between the strap of the auxiliary handle assembly and the barrel of the power tool.

5. The power tool assembly as recited in claim 4, wherein the adjusting assembly is an adjusting knob, the adjusting knob comprising a screw threaded into the yoke that moves along the axis of the handle and changes the angle between the linking arm and the lever.

6. The power tool assembly as recited in claim 1, further comprising a release pivotally coupled to the handle base, the release configured to pivot the lever away from the handle base when depressed to cause the over-center linkage to rotate over-center in a second direction to disengage the strap from the barrel portion to release the auxiliary handle assembly from the power tool.

7. The power tool assembly as recited in claim 6, wherein the release comprises a first portion extending away from the handle base and a second portion extending between the lever and the handle base, wherein depressing the first portion toward the handle base causes the second portion to pivot the lever away from the handle assembly.

8. The power tool assembly as recited in claim 1 wherein the strap includes a transverse row of teeth around the inside diameter of the strap to prevent the auxiliary handle assembly from slipping radially from the barrel of the power tool.

9. The power tool assembly as recited in claim 8 wherein the strap includes at least one lateral tooth parallel to the transverse row of teeth around the inside diameter of the strap to prevent the auxiliary handle assembly from slipping longitudinally from the barrel of the power tool.

10. The power tool assembly as recited in claim 1 wherein the strap includes a ridge-line support longitudinally across the outer circumference of the strap for increasing the strength and reducing the elasticity of the strap.

11. The power tool assembly as recited in claim 1, wherein the auxiliary handle assembly is interchangeable with differently sized straps to adapt to the size of the barrel of differently sized power tools.

12. An auxiliary handle assembly including:

a strap configured to encircle a barrel portion in a housing of a power tool, the strap having a first end and a second end;

a handle base coupled to the first end of the strap, the handle base having a chamber disposed therein, and a yoke disposed within the chamber; and an over-center linkage assembly disposed within the chamber, the over-center linkage assembly having a first end coupled to the yoke, a second end rotatably coupled to the second end of the strap, and a lever pivotally coupled to the handle base and the second end of the over-center linkage assembly, the lever configured to cause the second end of the over-center linkage assembly to rotate over center in a first direction when the lever is depressed against the handle base to engage the strap against the barrel portion for securing the auxiliary handle assembly to the power tool.

13. The auxiliary handle assembly as recited in claim 12, wherein the first end of the over-center linkage assembly further comprises a linking arm coupled to the yoke and the lever, and the second end of the over-center linkage assembly comprising a spindle having a first point, a second point and a third point, the spindle pivotably coupled to the handle base at the first point, the lever at the second point, and pivotably coupled to the second end of the strap at the third point, wherein the spindle is rotated around the second point of the spindle when the lever is depressed against the handle, rotating the strap about the third point of the spindle and closing the strap around the barrel portion of the housing of the power tool.

14. The power tool assembly as recited in claim 13, wherein the handle base includes an adjusting assembly, the adjusting assembly configured to adjust a clamping force between the strap of the auxiliary handle assembly and the barrel of the power tool.

15. The power tool assembly as recited in claim 14, wherein the adjusting assembly is an adjusting knob, the adjusting knob comprising a screw threaded into the yoke that moves along the axis of the handle and changes the angle between the linking arm and the lever.

16. The auxiliary handle as recited in claim 12, further comprising a release pivotally coupled to the handle base, the release configured to pivot the lever away from the handle base when depressed to cause the over-center linkage to rotate over-center in a second direction to disengage the strap from the barrel portion to release the auxiliary handle assembly from the power tool, wherein the release comprises a first portion extending away from the handle base and a second portion extending between the lever and the handle base, wherein depressing the first portion toward the handle base causes the second portion to pivot the lever away from the handle assembly.

17. An auxiliary handle assembly comprising:

a strap configured to encircle a barrel portion in a housing of a power tool, the strap having a first end and a second end;

a handle base coupled to the first end of the strap, the handle base having a chamber disposed in the handle base, and a yoke disposed within the chamber;

an over-center linkage assembly disposed within the chamber, the over-center linkage assembly having a first end coupled to the yoke, a second end rotatably coupled to the second end of the strap, and a lever pivotally coupled to the handle base and the second end of the over-center linkage assembly, the lever configured to cause the second end of the over-center linkage assembly to rotate over center in a first direction when the lever is depressed against the handle base to engage the strap against the barrel portion for securing the auxiliary handle assembly to the power tool; and a release pivotally coupled to the handle base, the release configured to pivot the lever away from the handle base when depressed to cause the over-center linkage to rotate over-center in a second direction to disengage the strap from the barrel portion to release the auxiliary handle assembly from the power tool.

18. The auxiliary handle assembly as recited in claim 17, wherein the over-center linkage assembly further comprises a linking arm coupled to the yoke and the lever, and a the second end of the over-center linkage assembly comprising a spindle having a first point, a second point and a third point, the spindle pivotably coupled to the handle base at the first point, the lever at the second point, and pivotably coupled to the second end of the strap at the third point, wherein the spindle is rotated around the second point of the spindle when the lever is depressed against the handle, rotating the strap about the third point of the spindle and closing the strap around the barrel portion of the housing of the power tool.

* * * * *